US008087404B2

(12) United States Patent
Saunders

(10) Patent No.: US 8,087,404 B2
(45) Date of Patent: Jan. 3, 2012

(54) SLINGSHOT POUCH

(76) Inventor: Charles A. Saunders, Columbus, NE (US)

( * ) Notice: Subject to any disclaimer, the term of this patent is extended or adjusted under 35 U.S.C. 154(b) by 114 days.

(21) Appl. No.: 12/684,770

(22) Filed: Jan. 8, 2010

(65) Prior Publication Data

US 2010/0170490 A1 Jul. 8, 2010

Related U.S. Application Data

(60) Continuation-in-part of application No. 12/343,978, filed on Dec. 24, 2008, now Pat. No. 7,827,977, which is a division of application No. 11/302,792, filed on Dec. 14, 2005, now Pat. No. 7,484,505.

(60) Provisional application No. 61/143,163, filed on Jan. 8, 2009, provisional application No. 60/638,547, filed on Dec. 22, 2004.

(51) Int. Cl.
*F41B 3/02* (2006.01)

(52) U.S. Cl. ..... 124/20.1

(58) Field of Classification Search ..... 124/20.1, 124/20.2, 20.3
See application file for complete search history.

(56) References Cited

U.S. PATENT DOCUMENTS

| | | | | |
|---|---|---|---|---|
| 2,644,441 | A * | 7/1953 | Simko | 124/5 |
| 2,996,060 | A * | 8/1961 | Appleby | 124/41.1 |
| 4,274,387 | A * | 6/1981 | McBride | 124/20.2 |
| 7,484,505 | B1 | 2/2009 | Saunders | |
| 7,509,952 | B2 * | 3/2009 | Aiken et al. | 124/20.1 |
| 7,861,700 | B2 * | 1/2011 | Scoggins | 124/41.1 |
| 2009/0173329 | A1 | 7/2009 | Saunders | |

* cited by examiner

*Primary Examiner* — John Ricci
(74) *Attorney, Agent, or Firm* — Levenfeld Pearlstein, LLC

(57) ABSTRACT

A slingshot pouch is disclosed. The pouch is configured to minimize contact with a projectile when it is being shot, thereby eliminating spin imparted on the projectile. This is accomplished using a pouch design configured to spring open immediately after release of the projectile. Several embodiments of such a pouch are disclosed. The disclosed embodiments comprise hinged members having various shapes, sizes and combinations of slits, opening and pockets configured to avoid imparting spin on the projectile. Also disclosed is a locking clip configured to secure such pouches to a slingshot band.

20 Claims, 10 Drawing Sheets

PRIOR ART

SLINGSHOT POUCH

CROSS-REFERENCE TO RELATED APPLICATIONS

This application claims the benefit of U.S. Provisional Application No. 61/143,163, filed Jan. 8, 2009, and is a continuation-in-part of U.S. application Ser. No. 12/343,978, filed Dec. 24, 2008, now pending, which is a divisional of U.S. application Ser. No. 11/302,792, filed Dec. 14, 2005, now patented.

BACKGROUND OF THE INVENTION

The present invention relates generally to slingshots and their components and, more particularly, to a slingshot pouch.

Slingshots commonly are used for recreation and for hunting. Although slingshots have existed for centuries, the basic design and mechanics generally have remained constant over time.

Quite simply, a traditional slingshot comprises a handle and a pair of arms extending divergently upward from the handle. An elastic band is attached between the arms. Typically, centered on the elastic band is a pouch designed to hold a projectile.

After a projectile is placed in the pouch, the pouch is pulled backwards, away from the arms, thereby extending and stretching the elastic band to create potential energy. When the pouch is released, the potential energy of the elastic band is transformed to kinetic energy which is transferred to the projectile through the pouch. The project then is thrust forward, out of the pouch, away from the slingshot user and toward a desired target.

Various design enhancements have been made over the years in an attempt to improve the functionality of slingshots. For example, such improved slingshot devices include wrist braces to help stabilize shots, foldable designs to make the devices more portable, aiming and sighting mechanisms to improve accuracy, multi-band designs to improve band life and shot speed and pulley assemblies to produce increased projectile velocity with decreased force exertion by the user.

One important area of development has involved the design of the slingshot pouch. Slingshot pouches have evolved significantly over the years. Early pouches were made of leather and sometimes included deformities or surface serrations designed to grip the projectile. Over the years, leather pouches were replaced with pouches made of other materials, including various types of plastics.

However, one of the most important characteristics that a slingshot pouch should have is that it should not impart spin (or rotation or bias) on the projectile being launched by the slingshot. A spinning or rotating projectile will tend to veer off-course increasing the likelihood that the projectile will not reach the desired target. Thus, such spinning or rotation is not desirable.

To that end, the art has developed slingshot pouches engineered to minimize the likelihood of imparting spin on the projectile as it is released from the pouch. The can involve engineering the pouch using particular designs and/or materials that allow the projectile to be quickly released from contact with pouch upon firing the slingshot.

One such slingshot pouch improvement is disclosed in U.S. Pat. No. 7,484,505, issued Feb. 3, 2009, for a "Collapsible Locking Slingshot," by Saunders, concurrently owned with the present application, and herein incorporated by reference. Saunders discloses a self-centering, open-pocket pouch that includes integrated exit ports to permit the projectile to exit the pouch without touching the sides of the pouch, thereby increasing the speed and accuracy of shooting a single or multiple projectile load. The Saunders pouch also is molded flat to help the pouch open with air pressure to ensure the projectile exits the pouch cleanly.

However, despite the numerous types slingshot pouches known in the prior art, the art has not developed a slingshot pouch that minimizes the contact between the pouch and the projectile during the shooting process. Minimizing such contact results in the projectile being thrust out of the pouch during the shooting process without imparting spin or bias on the projectile and causing it to veer off-target. The instant invention solves that problem and provides a slingshot pouch that imparts minimum spin on the projectile.

BRIEF SUMMARY OF THE INVENTION

The present invention comprises a slingshot pouch configured to minimize contact with the projectile when it is being shot, thereby eliminating any spin imparted on the projectile. This is accomplished using a pouch configured to spring open immediately upon release of the projectile.

In the preferred embodiment, the slingshot pouch of the present invention comprises an elongated hinged member with a slit or opening formed about hinge. Each half of the member is formed with a tapered pocket extending from the hinge substantially the entire length of each half. The pockets are formed with the deepest part of the tapered pocket adjacent to the hinge. The ends of each half of the hinged member are formed with integral slots for receiving the slingshot band. The slots are configured to engage a locking clip to lock the band to the pouch.

In another embodiment of the slingshot pouch of the present invention, the slit or opening between the halves of the hinged member is replaced with a large, semi-circular opening and a semi-spherical pocket formed extending rearwardly from the pouch. In this embodiment, a circular projectile can be cradled within the semi-spherical pocket when the pouch is gripped. The ends of each half of the hinged member are formed with integral slots for receiving the slingshot band. The slots are configured to engage a locking clip to lock the band to the pouch.

In yet another embodiment of the slingshot pouch of the present invention, the semi-circular opening of the previous embodiment is reduced to a slit extending only partially along the width of the pouch and the semi-spherical pocket of the previous embodiment is replaced with a semi-circular pocket. Again, the ends of each half of the hinged member are formed with integral slots for receiving the slingshot band. The slots are configured to engage a locking clip to lock the band to the pouch.

Also disclosed is a clip configured to engage the slots of the disclosed embodiments of the pouch of the present invention, and to lock the pouch to the band.

These and other features and advantages of the present invention will be apparent from the following detailed description, in conjunction with the appended claims.

BRIEF DESCRIPTION OF THE SEVERAL VIEWS OF THE DRAWINGS

The benefits and advantages of the present invention will become more readily apparent to those of ordinary skill in the relevant art after reviewing the following detailed description and accompanying drawings, wherein.

DETAILED DESCRIPTION OF THE INVENTION

Figure 1:
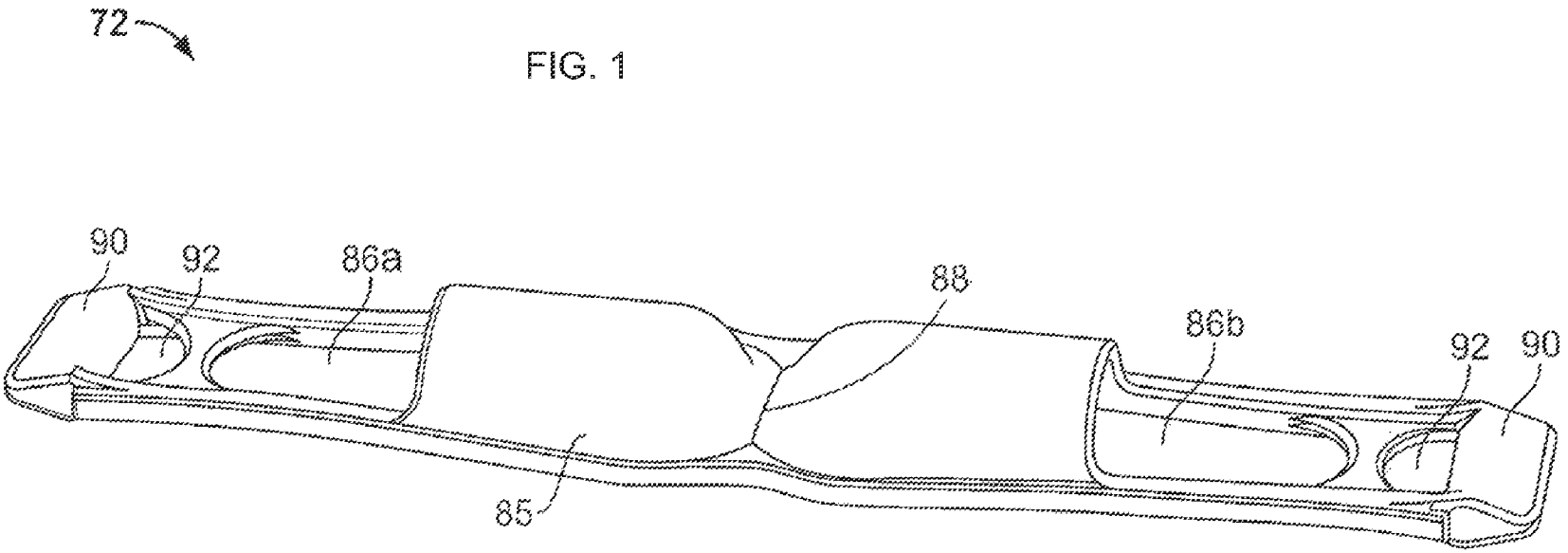
FIG. 1 PRIOR ART
FIG. 1 is a perspective view of a self-centering, open-pocket pouch as is known in the prior art, shown in a fully open configuration.

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiment illustrated.

It should be further understood that the title of this section of this specification, namely, "Detailed Description of the Invention," relates to a requirement of the United States Patent Office, and does not imply, nor should be inferred to limit the subject matter disclosed herein.

As discussed above, slingshot pouches are known in the art that are configured to help reduce the spin imparted upon a projectile upon release of the projectile from the pouch during firing. One such slingshot pouch improvement is disclosed in U.S. Pat. No. 7,484,505, issued Feb. 3, 2009, for a "Collapsible Locking Slingshot," by Saunders, concurrently owned with the present application, and herein incorporated by reference.

Figure 2:
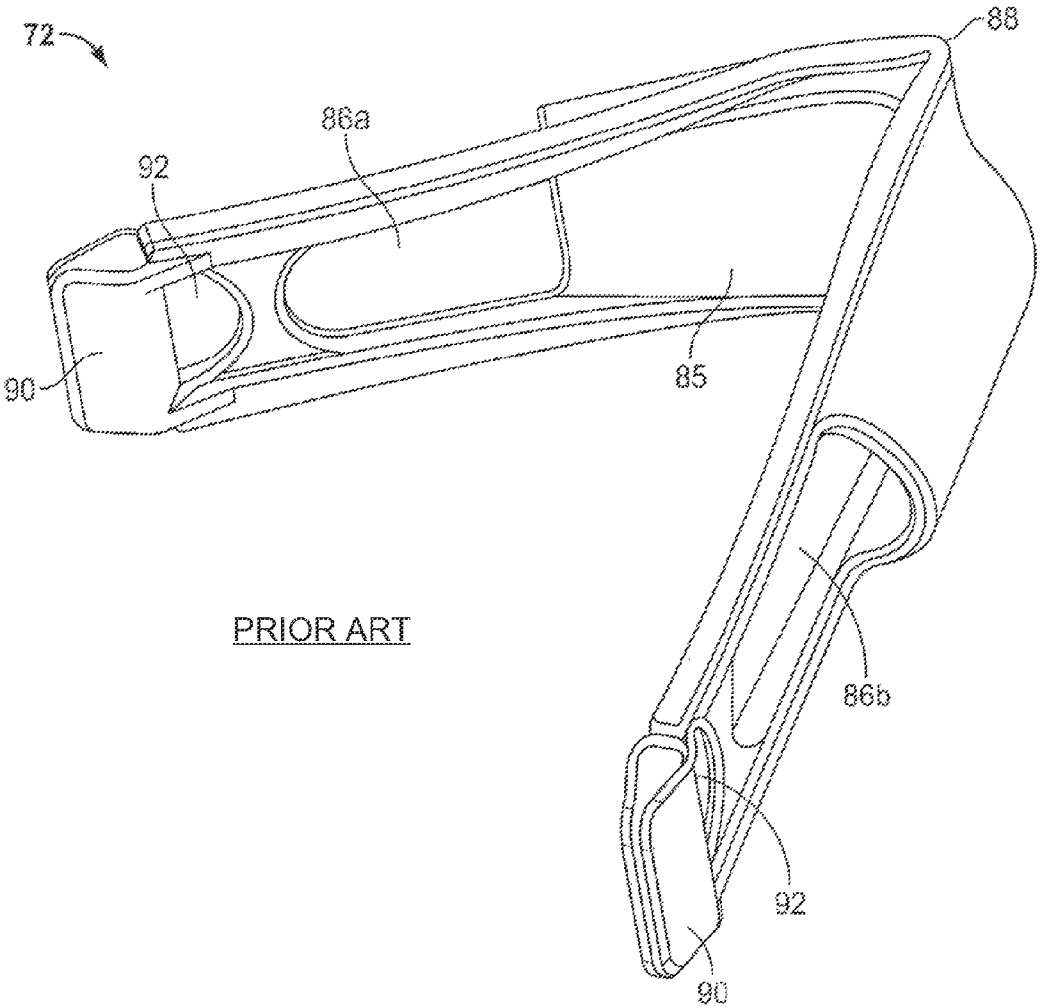
FIG. 2 is a perspective view of the self-centering, open-pocket pouch of FIG. 1, shown in a partially folded configuration.

Specifically, as shown in FIGS. 1 and 2, Saunders disclosed a self-centering, open-pocket pouch 72. The pouch 72 preferably is about ⅝ inch wide and is constructed of polyethylene (Noveon's Estane 58134). The choice of material, small size, and skeletal design results in a dramatically lighter pouch than conventional prior art designs. This weight reduction results in a faster slingshot.

Pouch 72 includes a centered pouch section 85, which is configured with two integrated exit ports 86*a* and 86*b*, one on each side of centered pouch section 85 joined by a central flexing live-hinge 88. Ports 86*a* and 86*b* permit the projectile to exit centered pouch section 85 without making contact against the sides of the pouch by allowing air to enter the pouch and expand the pouch outward, away from the projectile (much like a parachute opening).

Centered pouch section 85 is molded substantially flat, which helps it open along with the air pressure. Reduction or elimination of side pouch contact improves shot accuracy since any contact along the sides will either deflect the projectile path or apply spin to the projectile (typically a ball, pellet or multiple pellets) causing it to curve much the same way a pitcher applies spin to a baseball to make it curve in its path. Ports 86*a* and 86*b* can be elliptical in shape, extremely elongated elliptical in shape, or can be empty of material as shown in FIGS. 1 and 2.

Regardless of the shape of ports 86*a* and 86*b*, the design of pouch 72 takes advantage of the user's need to grip the pouch during the firing process to automatically center the projectile within it. By necessity, a user's fingers will pinch the forward opening of centered pouch section 85 closed during use, since the user must grip the pouch in front of the projectile in order to hold the pouch during the firing process.

This gripping process, in conjunction with the radii in the rear section of centered pouch section 85, provides a nesting area for the projectile during the launch phase. This nesting area cradles the projectile in a generally centered configuration within the pouch. Because it is centered within centered pouch section 85, upon release the projectile is less likely to contact either side of the pouch and, therefore, is less likely to be deflected. This results in a more accurate and predictable shot.

Prior art pouch 72 also includes a pair of ends 90, each with an aperture 92 to permit bands 60 (shown in FIG. 10) to slip through apertures 92 and to allow pouch 72 to be connected to bands 60 using known prior art techniques.

While prior art pouch 72 represents a significant improvement over the earlier prior art, different slingshot pouch configurations can result in additional performance enhancements. To that end, the slingshot pouch of the present invention provides such performance enhancements over the prior art by providing configurations that further reduce the contact between the pouch and the projectile upon firing, thereby eliminating any spin imparted on the projectile. This is accomplished using pouch designs that spring open immediately after release of the projectile.

Figure 3:
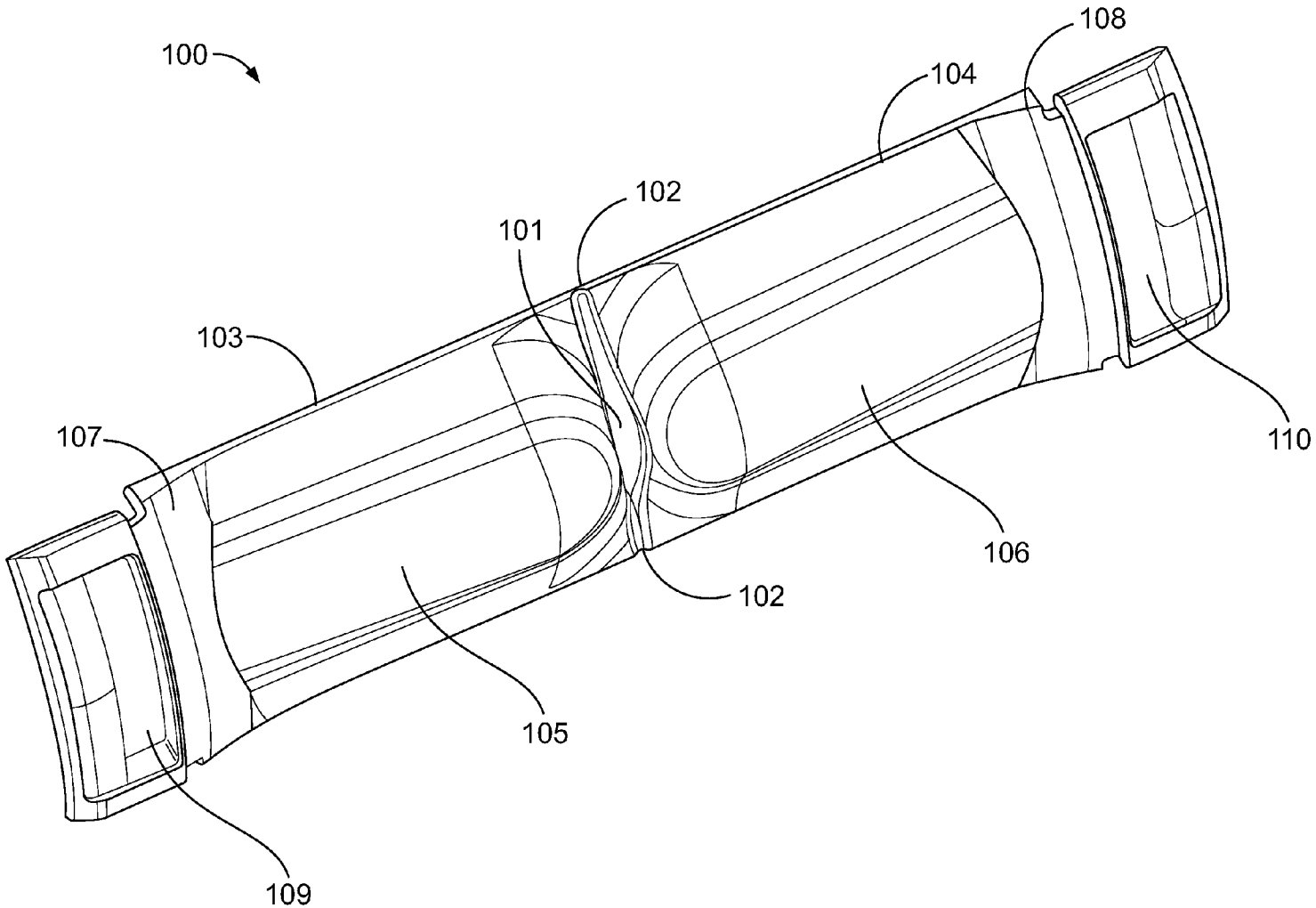
FIG. 3 is a rear perspective view of the preferred embodiment of the slingshot pouch of in accordance with the principles of the present invention.
Figure 4:
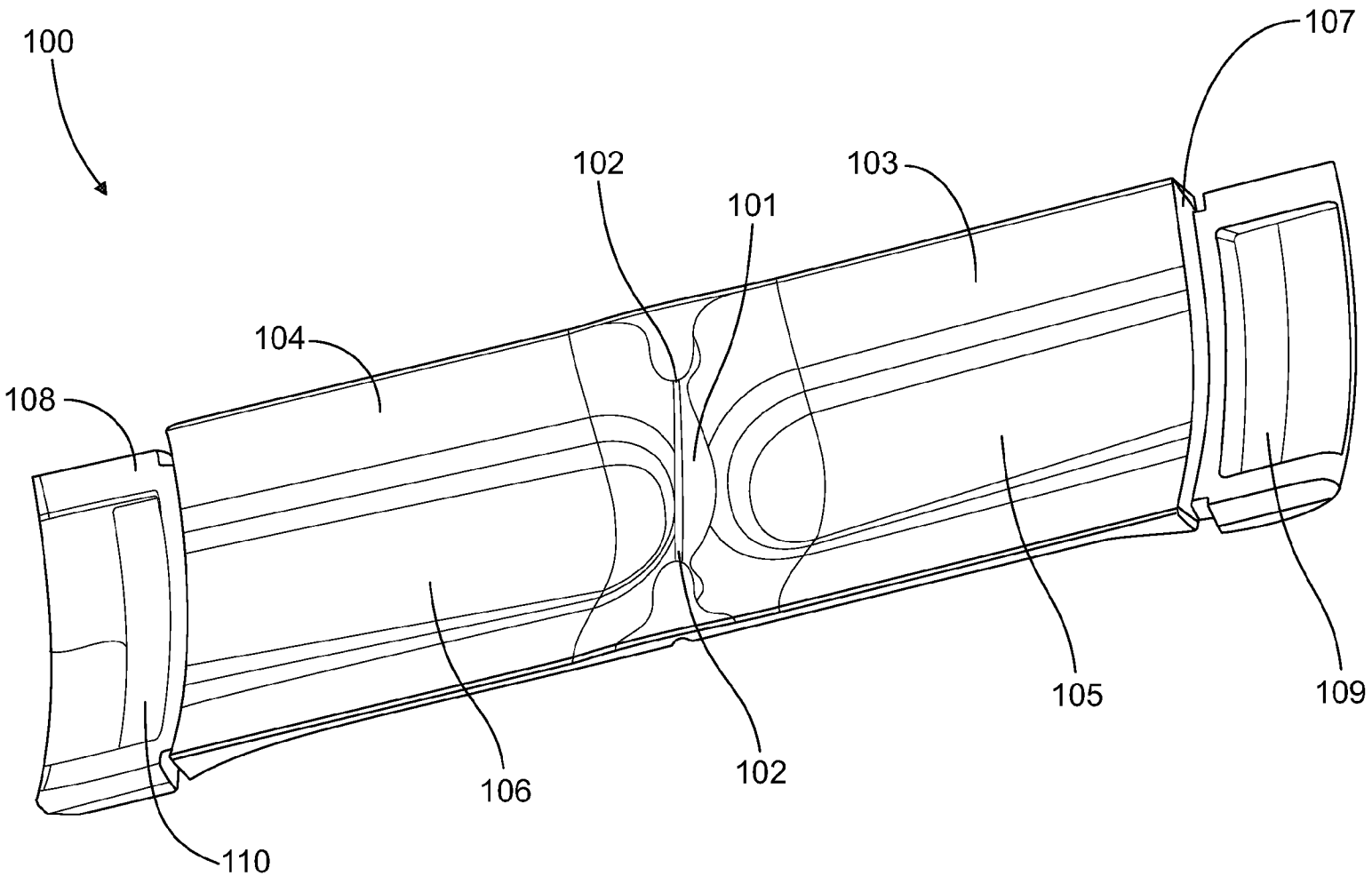
FIG. 4 is a front perspective view of the preferred embodiment of the slingshot pouch of in accordance with the principles of the present invention.

As shown in FIGS. 3 and 4, the preferred embodiment of the slingshot pouch 100 of the present invention comprises an elongated member having a hinge 102 disposed between two halves 103 and 104. A slit or opening 101 is formed about and integral with hinge 102 such that hinge 102 connects two halves 103 and 104 only at the upper and lower ends of the width of pouch 100. That is, halves 103 and 104 are not connected to each other across the entire width of pouch 100.

Slit or opening 101 preferably is formed in an oblong shape, with its central width greater than its outer width. In this manner, pouch 100 is particularly suitable for round projectiles, as the shape of slit or opening 101 facilitates gripping such round projectiles when preparing to fire the slingshot. However, those skilled in the art will recognize that other sizes and geometries of slit or opening 101 are possible depending on the size and geometry of the projectile, and such other sizes and geometries are included within the scope of the present invention.

Each half 103 and 104 of pouch 100 of the present invention is formed with a tapered pocket (105 and 106, respectively) extending from hinge 102 along substantially the entire length of each half 103 and 104. Pockets 105 and 106 are configured such that the deepest part of each pocket 105 and 106 is adjacent to hinge 102 with the depth of the pockets 105 and 106 decreasing as they approach the ends (107 and 108, respectively) of pouch 100 where pockets 105 and 106 become substantially flat.

Pockets 105 and 106 preferably are formed in generally partial-capsule shaped geometry with the rounded end of each capsule disposed adjacent to hinge 102. In this manner, again, pouch 100 is particularly suitable for round projectiles, as the shape pockets 105 and 106 will facilitate gripping such round projectiles when preparing to fire the slingshot.

Moreover, the geometry of pockets 105 and 106 advantageously facilitates air to enter the pouch and expand the pouch outward, away from the projectile (much like a parachute opening) during launch. However, those skilled in the art will recognize that other sizes and geometries of pockets 105 and 106 are possible depending on the size and geometry of the projectile, and such other sizes and geometries are included within the scope of the present invention.

Figure 9:
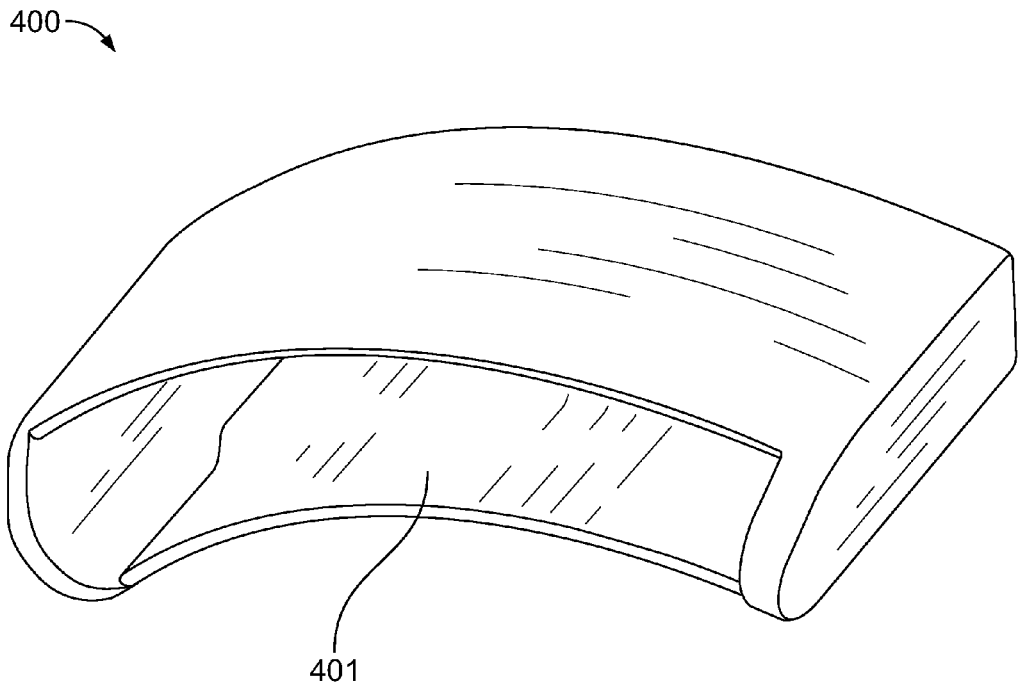
FIG. 9 is a perspective view of the clip for the slingshot pouch in accordance with the principles of the present invention; and, FIG. 10 is a perspective view of a prior art slingshot showing a prior art pouch attached to the slingshot with bands.
Figure 10:
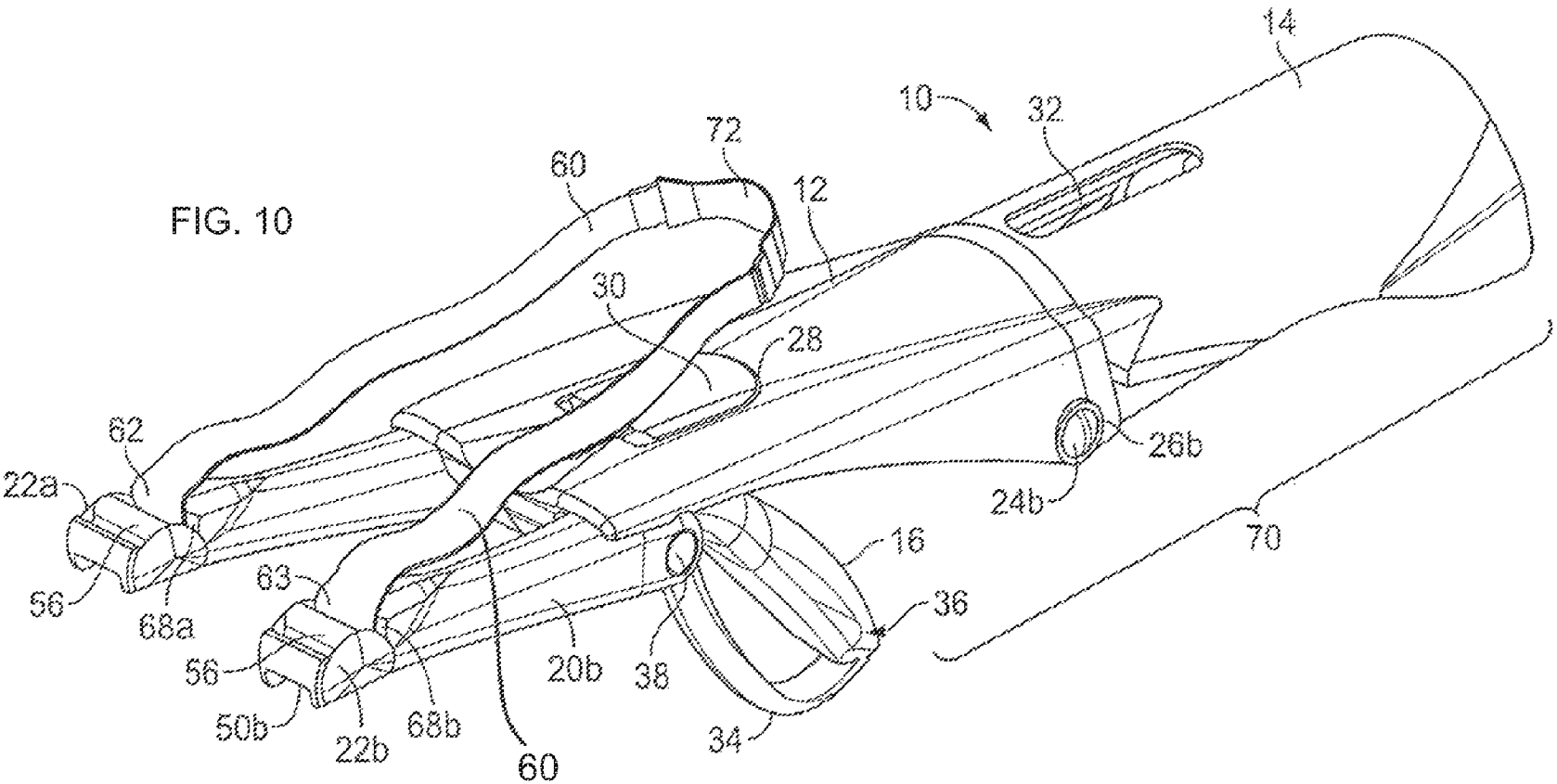
FIG. 10 PRIOR ART

Ends 107 and 108 of each half (103 and 104, respectively) of pouch 100 preferably are formed with integral slots (109 and 110, respectively) for receiving the slingshot bands 60 (shown in FIG. 10). Slots 109 and 110 are configured to engage a locking clip (shown in FIG. 9), as further discussed below, to lock pouch 100 to bands 60.

In the preferred embodiment, pouch 100 is formed using a mix of 50% Estane and 50% Hytrel. However, those skilled in the art will recognize that other suitable materials may be used for pouch 100, such as polyethylene and other plastic materials. All such materials are included within the scope of the present disclosure.

Figure 5:
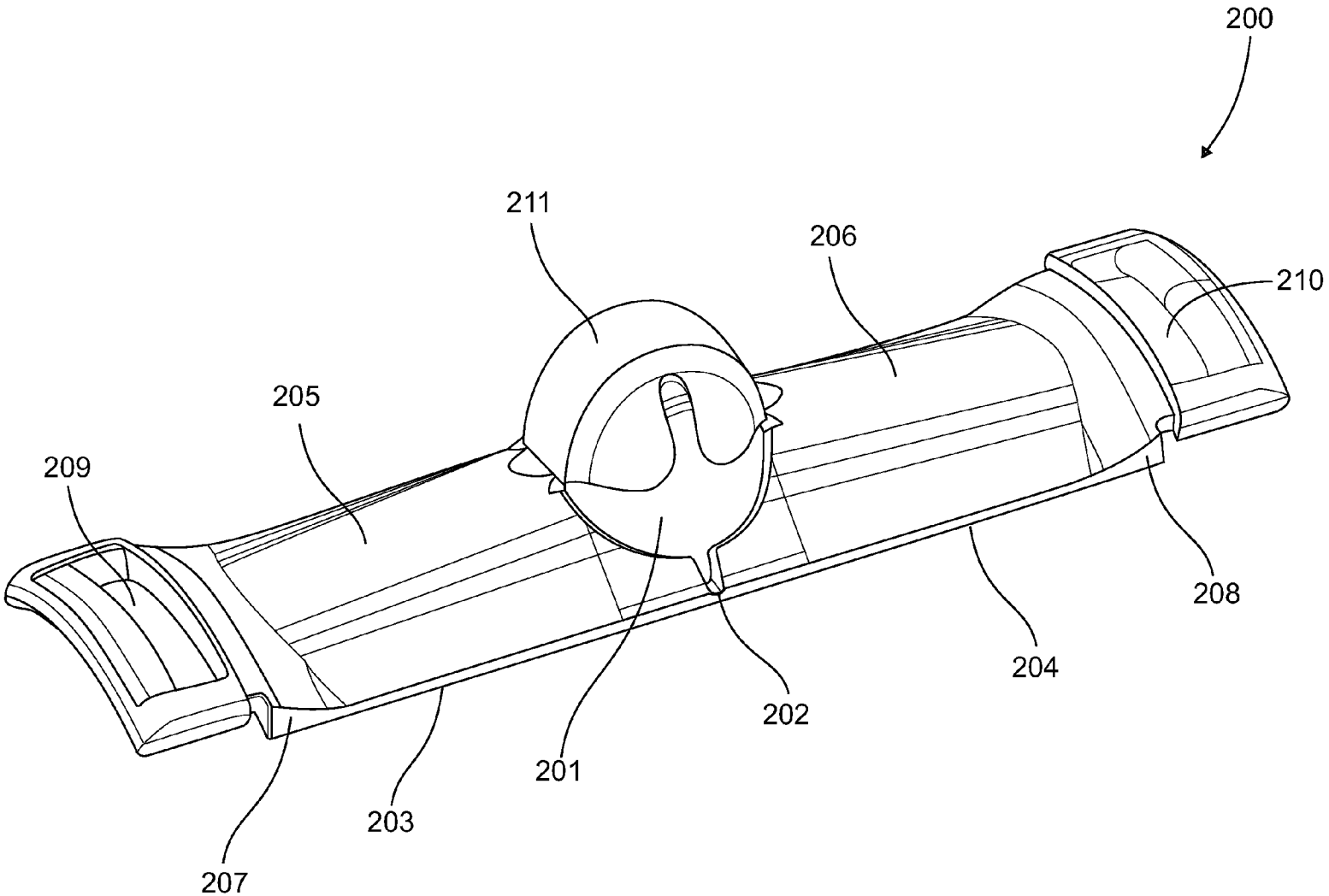
FIG. 5 is a perspective rear view of the second embodiment of the slingshot pouch in accordance with the principles of the present invention.
Figure 6:
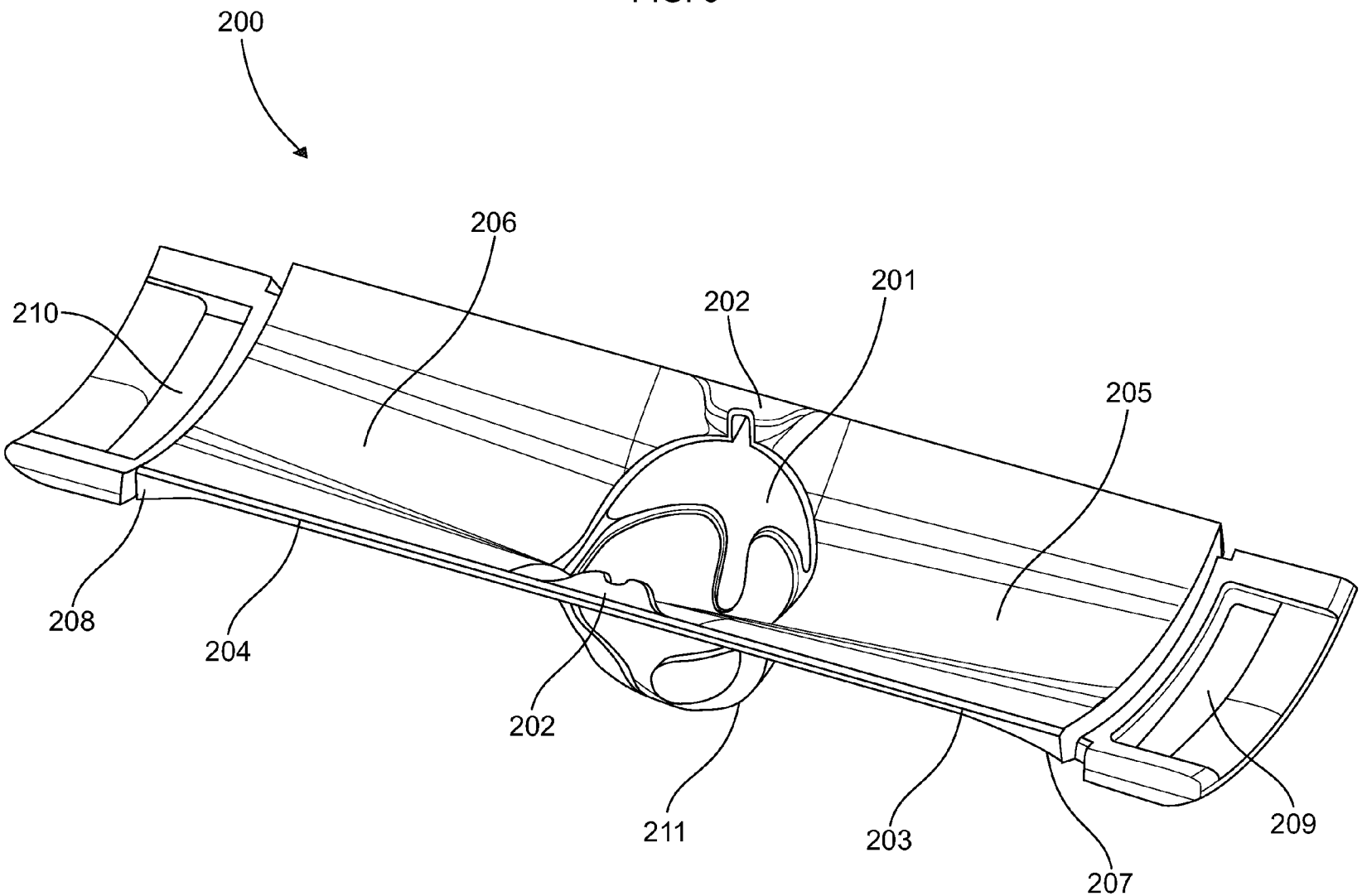
FIG. 6 is a perspective front view of the second embodiment of the slingshot pouch in accordance with the principles of the present invention.

A second embodiment of the slingshot pouch of the present invention is shown in FIGS. 5 and 6. In this embodiment, slingshot pouch 200 of the present invention again comprises an elongated member having a hinge 202 disposed between two halves 203 and 204. An opening 201 is formed about and integral with hinge 202 such that hinge 202 connects two halves 203 and 204 only at the upper and lower ends of the width of pouch 200. That is, halves 203 and 204 are not connected to each other across the entire width of pouch 200.

In this embodiment, opening 201 preferably is formed in a semi-circular shape and extends into halves 203 and 204 at a distance greater than slit or opening 101 of pouch 100 extends into halves 103 and 104 of pouch 100 in the preferred embodiment of the present invention, as discussed above.

Additionally, in this embodiment, pouch 200 further comprises a semi-spherical pocket 211 formed about and integral with hinge 202, and extending rearwardly from pouch 200. The diameter of pocket 211 preferably is about equal to the diameter of opening 201.

In this manner, pouch 200 is particularly suitable for round projectiles, as the circular/spherical shapes of opening 201 and pocket 211 creates a cradle for projectiles of such shape and facilitates gripping such round projectiles when preparing to fire the slingshot. However, those skilled in the art will recognize that other sizes and geometries of opening 201 and pocket 211 are possible depending on the size and geometry of the projectile, and such other sizes and geometries are included within the scope of the present invention.

Each half 203 and 204 of pouch 200 of this embodiment of the present invention preferably is formed with a tapered walls (205 and 206, respectively) extending from hinge 202 along substantially the entire length of each half 203 and 204. Tapered walls 205 and 206 preferably are configured such that the deepest part of each wall 205 and 206 is adjacent to hinge 202 with the depth of tapered walls 205 and 206 decreasing as they approach the ends (207 and 208, respectively) of pouch 200.

Moreover, the geometry of tapered walls 205 and 206 advantageously facilitates air to enter pouch 200 and expand pouch 200 outward, away from the projectile (much like a parachute opening) during launch. However, those skilled in the art will recognize that other sizes and geometries of tapered walls 205 and 206 are possible depending on the size and geometry of the projectile, and such other sizes and geometries are included within the scope of the present invention.

Ends 207 and 208 of each half (203 and 204, respectively) of pouch 200 preferably are formed with integral slots (209 and 210, respectively) for receiving the slingshot bands 60 (shown in FIG. 10). Slots 209 and 210 are configured to engage a locking clip (shown in FIG. 9), as further discussed below, to lock pouch 200 to bands 60.

Figure 7:
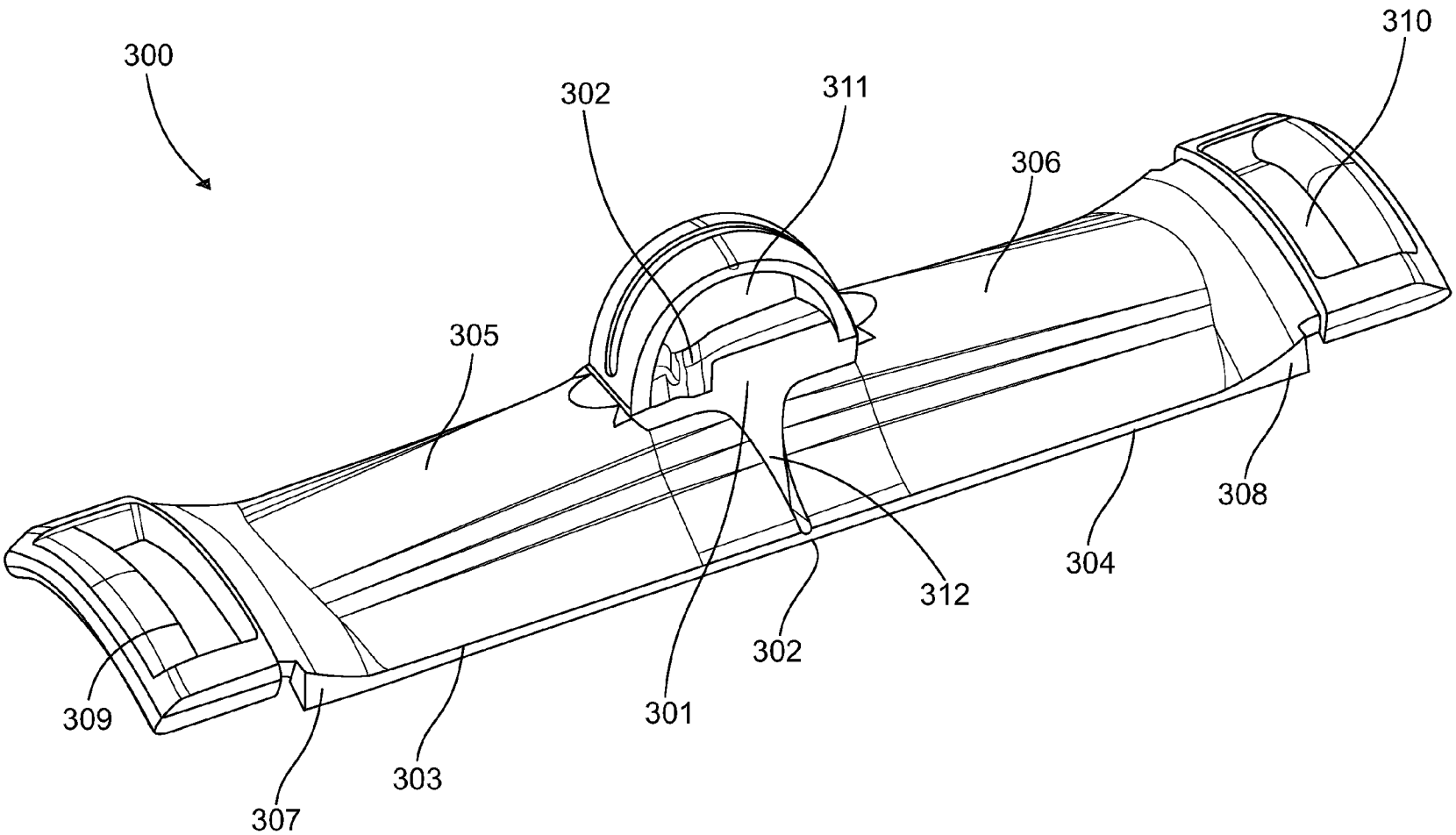
FIG. 7 is a perspective rear view of the third embodiment of the slingshot pouch in accordance with the principles of the present invention.
Figure 8:
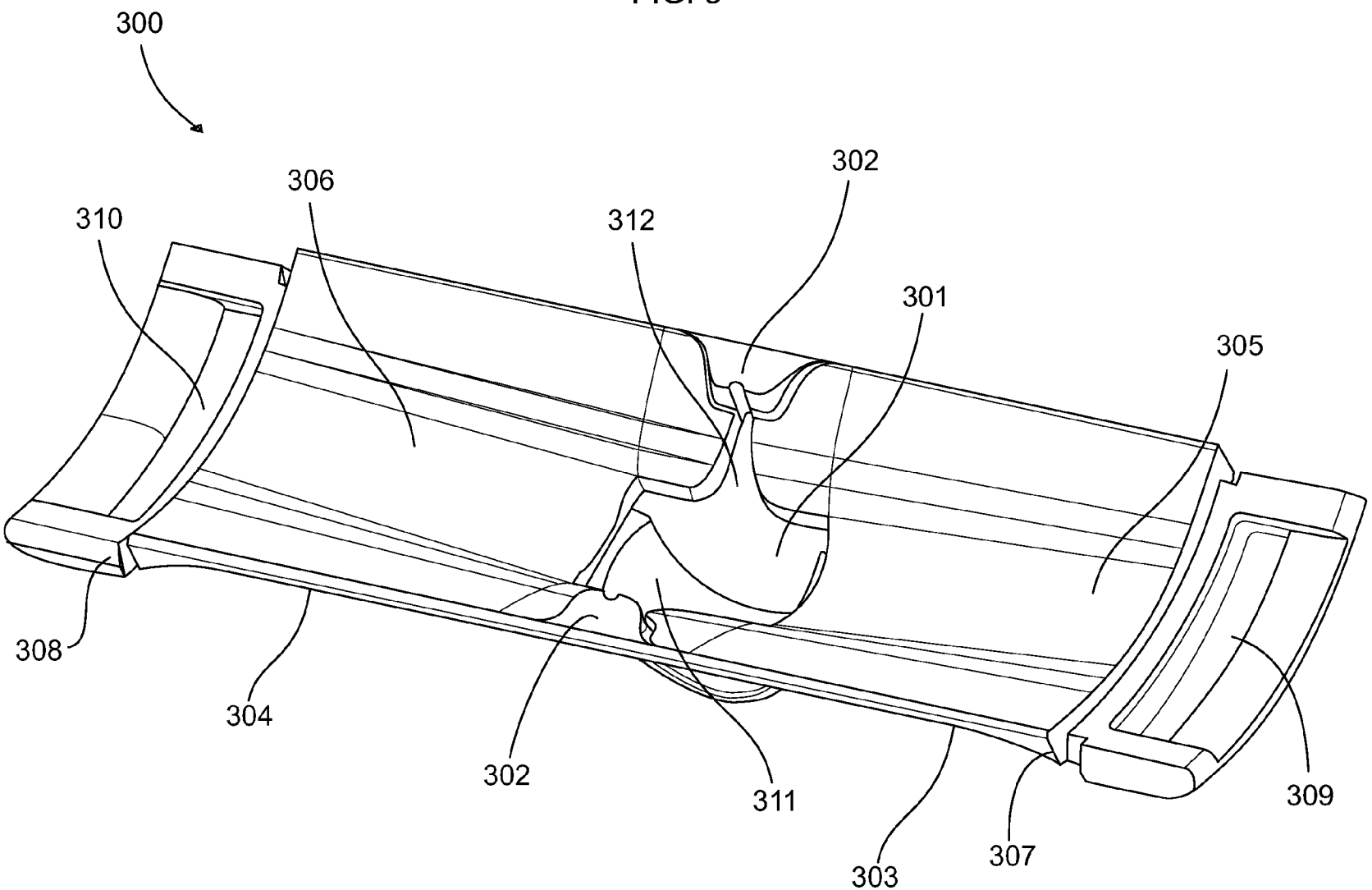
FIG. 8 is a perspective front view of the third embodiment of the slingshot pouch in accordance with the principles of the present invention.

A third embodiment of the slingshot pouch of the present invention is shown in FIGS. 7 and 8. In this embodiment, slingshot pouch 300 of the present invention again comprises an elongated member having a hinge 302 disposed between two halves 303 and 304. An opening 301 is formed about and integral with hinge 302 such that hinge 302 connects two halves 303 and 304 only at the upper and lower ends of the width of pouch 300. That is, halves 303 and 304 are not connected to each other across the entire width of pouch 300.

In this embodiment, opening 301 preferably extends across only about half (the lower half) of the width of pouch 300. Disposed above opening 301 is a slit 312 formed about and integral with hinge 302. Slit 312 extends across only about half (the upper half) of the width of pouch 300.

Additionally, in this embodiment, pouch 300 further comprises a semi-circular pocket 311 formed about and integral with hinge 302, and extending rearwardly from pouch 300 across only about half (the lower half) of the width of pouch 300. The diameter of pocket 311 preferably is about equal to the diameter of opening 301.

In this manner, pouch 300 is particularly suitable for round projectiles, as the circular shape of pocket 311 creates a cradle for projectiles of such shape and facilitates gripping such round projectiles when preparing to fire the slingshot. However, those skilled in the art will recognize that other sizes and geometries of pocket 311 are possible depending on the size and geometry of the projectile, and such other sizes and geometries are included within the scope of the present invention.

Each half 303 and 304 of pouch 300 of this embodiment of the present invention preferably is formed with a tapered walls (305 and 306, respectively) extending from hinge 302 along substantially the entire length of each half 303 and 304. Tapered walls 305 and 306 preferably are configured such that the deepest part of each wall 305 and 306 is adjacent to hinge 302 with the depth of tapered walls 305 and 306 decreasing as they approach the ends (307 and 308, respectively) of pouch 300.

Moreover, the geometry of tapered walls 305 and 306 advantageously facilitates air to enter pouch 300 and expand pouch 300 outward, away from the projectile (much like a parachute opening) during launch. However, those skilled in the art will recognize that other sizes and geometries of tapered walls 305 and 306 are possible depending on the size and geometry of the projectile, and such other sizes and geometries are included within the scope of the present invention.

Ends 307 and 308 of each half (303 and 304, respectively) of pouch 300 preferably are formed with integral slots (309 and 310, respectively) for receiving the slingshot bands 60 (shown in FIG. 10). Slots 309 and 310 are configured to engage a locking clip (shown in FIG. 9), as further discussed below, to lock pouch 300 to bands 60.

As shown in FIG. 9, clip 400 is configured to connect the slingshot pouch of the present invention to slingshot bands 60 (as shown in FIG. 10). In the preferred embodiment, clip 400 is a curved, generally crescent-shaped member having a opening 401 formed therethrough. Clip 400 is configured to slide over slots (109 and 110, 209 and 210, and 309 and 310 of slingshot pouches 100, 200 and 300 of the present invention) and to frictionally engage bands 60 between clip 400 and the slots, as bands 60 are disposed in the slots.

In this manner, clip 400 locks the pouch to the bands. However it will be appreciated that in some embodiments, clip 400 may be supplemented with a flexible contact cement or other suitable adhesive to help secure the pouch to the bands. Secure engagement of the pouch and bands helps keep the bands close to the pouch prevents them from flaring open, and also keeps the bands from creeping off-center lengthwise causing side to be shorter than the other.

In the preferred embodiment, clip 400 is formed from polyethylene. However, those skilled in the art will recognize that other materials can be used without departing from the scope of the instant invention.

All patents referred to herein, are hereby incorporated herein by reference, whether or not specifically done so within the text of this disclosure.

In the present disclosure, the words "a" or "an" are to be taken to include both the singular and the plural. Conversely, any reference to plural items shall, where appropriate, include the singular.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

What is claimed is:

1. A slingshot pouch, the pouch comprising:

an elongated member having a first half, a second half and a width;

a hinge disposed between the first half and the second half, the hinge connecting the first half and the second half across less than the entire width of the member;

a slit formed about and integral with the hinge;

a first pocket formed in the first half and a second pocket formed in the second half; and a first end and a second end, the first end and the second end configured to connect to at least one slingshot band.

2. The slingshot pouch of claim 1 wherein the slit has an oblong shape.

3. The slingshot pouch of claim 1 wherein the slit has a central width that is greater than an outer width.

4. The slingshot pouch of claim 1 wherein the first pocket and the second pocket are tapered.

5. The slingshot pouch of claim 4 wherein the first pocket and the second pocket are tapered such that a first depth of the first pocket nearer the hinge is greater than a second depth of the first pocket further from the hinge, and a third depth of the second pocket nearer the hinge is greater than a fourth depth of the second pocket further from the hinge.

6. The slingshot pouch of claim 1 wherein the first pocket and the second pocket are formed in a partial-capsule shape.

7. The slingshot pouch of claim 1 further comprising a first slot integral with the first end and second slot integral with the second end.

8. The slingshot pouch of claim 1 further comprising a clip, the clip configured to secure the pouch to the at least one slingshot band.

9. A slingshot pouch, the pouch comprising:

an elongated member having a first half, a second half and a width;

a hinge disposed between the first half and the second half, the hinge connecting the first half and the second half across less than the entire width of the member;

an opening formed about and integral with the hinge;

a first tapered wall formed in the first half and a second tapered wall formed in the second half;

a first end and a second end, the first end and the second end configured to connect to at least one slingshot band; and a pocket formed about and integral with the hinge, the pocket extending rearwardly from the member.

10. The slingshot pouch of claim 9 wherein the opening has a semi-circular shape.

11. The slingshot pouch of claim 9 wherein the pocket has a semi-spherical shape.

12. The slingshot pouch of claim 9 wherein the opening has a semi-circular shape having a first diameter, and the pocket has a semi-spherical shape having a second diameter, the first diameter being approximately equal to the second diameter.

13. The slingshot pouch of claim 9 wherein the first tapered wall is tapered away from the hinge and the second tapered wall is tapered away from the hinge.

14. The slingshot pouch of claim 9 further comprising a first slot integral with the first end and second slot integral with the second end.

15. The slingshot pouch of claim 9 further comprising a clip, the clip configured to secure the pouch to the at least one slingshot band.

16. A slingshot pouch, the pouch comprising:

an elongated member having a first half, a second half and a width;

a hinge disposed between the first half and the second half, the hinge connecting the first half and the second half across less than the entire width of the member;

an opening formed about and integral with the hinge, the opening extending across about half of the width of the member;

a first tapered wall formed in the first half and a second tapered wall formed in the second half;

a first end and a second end, the first end and the second end configured to connect to at least one slingshot band; and a pocket formed about and integral with the hinge, the pocket extending rearwardly from the member and extending across about half of the width of the member.

17. The slingshot pouch of claim 16 wherein the pocket has a semi-circular shape.

18. The slingshot pouch of claim 16 wherein the first tapered wall is tapered away from the hinge and the second tapered wall is tapered away from the hinge.

19. The slingshot pouch of claim 16 further comprising a first slot integral with the first end and second slot integral with the second end.

20. The slingshot pouch of claim 16 further comprising a clip, the clip configured to secure the pouch to the at least one slingshot band.

* * * * *

UNITED STATES PATENT AND TRADEMARK OFFICE

CERTIFICATE OF CORRECTION

PATENT NO. : 8,087,404 B2
APPLICATION NO. : 12/684770
DATED : January 3, 2012
INVENTOR(S) : Charles A. Saunders It is certified that error appears in the above-identified patent and that said Letters Patent is hereby corrected as shown below:

In column 1, line 31, the phrase "The project then" should read "The projectile then".

In column 1, line 58, the phrase "The can involve" should read "This can involve".

In column 3, line 8, the phrase "the slingshot pouch of in accordance" should read "the slingshot pouch in accordance".

In column 5, line 56, the phrase "with a tapered walls" should read "with tapered walls".

In column 7, lines 11-12, the phrase "helps keep the bands close to the pouch prevents them from flaring open," should read "helps keep the bands close to the pouch, prevents them from flaring open,".

In column 7, line 14, the phrase "causing side to be shorter" should read "causing one side to be shorter".

Signed and Sealed this
Tenth Day of July, 2012

David J. Kappos

David J. Kappos
*Director of the United States Patent and Trademark Office*